United States Patent [19]

Kawamura

[11] Patent Number: 4,792,300

[45] Date of Patent: Dec. 20, 1988

[54] ATOMIZING BURNER

[75] Inventor: Hideo Kawamura, Fujisawa, Japan

[73] Assignee: Izuzu Motors Limited, Tokyo, Japan

[21] Appl. No.: 77,208

[22] Filed: Jul. 24, 1987

[30] Foreign Application Priority Data

Aug. 6, 1986 [JP] Japan ..... 61-183406

[51] Int. Cl.[4] ..... F23D 11/44

[52] U.S. Cl. ..... 431/247; 431/352; 431/353

[58] Field of Search ..... 431/247, 242, 353, 352, 431/161; 123/179 H, 550, 551

[56] References Cited

U.S. PATENT DOCUMENTS

| | | | |
|---|---|---|---|
| 3,570,828 | 3/1971 | Cowan | 431/247 X |
| 3,589,315 | 6/1971 | Hart | 431/353 X |
| 3,847,534 | 11/1974 | Nomaguchi et al. | 431/353 X |
| 4,684,341 | 8/1987 | Kawamura et al. | 431/242 |

FOREIGN PATENT DOCUMENTS

| | | |
|---|---|---|
| 207330 | 3/1985 | Japan . |
| 120842 | 10/1985 | Japan . |
| 252018 | 12/1985 | Japan . |
| 79864 | 4/1986 | Japan . |

*Primary Examiner*—Randall L. Green
*Attorney, Agent, or Firm*—Browdy and Neimark

[57] ABSTRACT

In a burner, a combustion cylinder made of a ceramic material is divided into an atomizing chamber and a combustion chamber by a partitioning plate having openings, a fuel injection port of an atomizing device is opened in the combustion chamber, the atomizing device emerging from a corner portion on the downstream side of the combustion cylinder and penetrating through the combustion chamber, an outer cylinder is so arranged as to form an annular air introducing path along the outer circumference of the combustion cylinder, and air introducing holes are formed in the combustion cylinder being tilted along the line of air stream. The outer cylinder is provided with an air intake pipe in the radial direction thereof. The tilting angle of the air introducing holes formed in the combustion cylinder gradually increases starting from a portion opposed to the air intake port formed in the outer cylinder and then gradually decreases as it goes to the side opposite to the air intake port. The atomizing device has a glow plug for atomization, which consists of a resistance wire buried in a silicon nitride member. Further, in the atomizing chamber is disposed another glow plug for ignition.

7 Claims, 2 Drawing Sheets

ATOMIZING BURNER

BACKGROUND OF THE INVENTION

1. Field of the Invention

The present invention relates to a burner that can be adapted to indirect or direct heating devices employed in vehicles which mount an internal combustion engine, in such vehicles as trailers, in the rooms of houses, drying rooms and offices, and that can be used for driers, boilers, water heaters and green houses.

2. Description of the Prior Art

There has heretofore been known a heating device for automobiles (see, for example, Japanese Patent Laid-Open No. 252018/1985) which heats the room by burning a fuel in a burner which is provided separately from an internal combustion engine. There has further been known a device for warming up the engine (see, for example, Japanese Patent Laid-Open No. 79864/1986) according to which a combustion gas of a burner is supplied to an intake port of an engine via a heat exchanger, and the air heated through the heat exchanger is introduced into the room. The above-mentioned heating device for automobiles and the device for warming up the engine require time and laborious work with regard to adjusting the combustion period and treating the exhaust gases, and further necessitate complex mechanism and control device.

Prior art can be represented by burners disclosed in Japanese patent applications Nos. 120842/1985 and 207330/1985 filed by the applicant of the present application.

First, the burner disclosed in Japanese patent application No. 207330/1985 will be briefly described in conjunction with FIG. 3. In this burner, the interior of a combustion cylinder 51 is divided into an atomizing chamber 54 and a combustion chamber 56 having air introducing holes 55 in the peripheral wall thereof by a partitioning plate 52 that has a plurality of cut-away paths 53 in the peripheral portion thereof. Further, provision is made of a fuel atomizer that has a nozzle 57 open in the atomizing chamber 54 to inject fuel for atomization and that has fins 58 on the outer peripheral surface thereof. In FIG. 3, reference numeral 59 denotes a cover plate. With regard to introducing the air for combustion, the above burner fails to favorably introduce the combustion air from the annular space, i.e., from the annular air introducing path into the combustion cylinder. After the air has been introduced, furthermore, the combustion air and the atomized fuel are not mixed well with each other to form a desirable mixture, leaving much room for improvement.

The burner (not shown) disclosed in Japanese patent application No. 120842/1985 will be briefly described next. A rectifier wall plate is held in the combustion cylinder to divide it into an atomizing chamber and a combustion chamber, air intake ports are formed in the wall that surrounds the combustion chamber of the combustion cylinder being arranged maintaining a distance in the circumferential direction, the air intake ports being tilted in the same direction relative to the center of the combustion cylinder, and an exhaust port is provided in an end wall that divides the combustion chamber of the combustion cylinder. In the thus constructed burner, the air intake ports, i.e., the air introducing holes formed in the combustion cylinder, are tilted in the same direction with respect to the center of the combustion cylinder. This burner, however, is quite different from the burner of the present invention with respect to atomizing the fuel, forming the mixture and sustaining the combustion, and with respect to the direction for introducing the air.

SUMMARY OF THE INVENTION

The object of the present invention is to eliminate the above-mentioned problems by providing a burner in which a fuel is quickly atomized, and the atomized fuel and the combustion air are mixed together so that it burns, wherein the combustion air is introduced from the periphery of the combustion cylinder into the combustion cylinder smoothly under reduced resistance condition, part of the combustion air is also easily introduced into the atomizing chamber, the atomized fuel is very favorably ignited and in the combustion chamber, the atomized fuel and the combustion air are favorably mixed together to form a mixture which burns briskly.

Another object of the present invention is to provide a burner is which a combustion cylinder made of a ceramic material is divided into an atomizing chamber and a combustion chamber by a partitioning plate having openings, a fuel injection port of an atomizer is opened in said atomizing chamber, said atomizer emerging from a corner portion on the downstream side of the combustion chamber and penetrating through the combustion chamber, an outer cylinder is so arranged as to form an annular air introducing path that surrounds said combustion cylinder, and air introducing holes formed in the combustion cylinder are tilted along the line of air stream.

A further object of the present invention is to provide a burner in which a liquid fuel is atomized at a rapid rate by an atomizer to form atomized fuel, the atomized fuel is injected into an atomizing chamber where it is favorably mixed with the combustion air introduced into the combustion cylinder, said mixture is ignited to burn briskly, and the combustion gas is vigorously delivered from the combustion chamber.

Still further object of the present invention is to provide a burner in which an air intake pipe is mounted on the outer cylinder in the radial direction thereof, and the tilting angle of the air introducing holes formed in the combustion cylinder is gradually increased starting from a portion that faces the air intake port formed in the outer cylinder and is then gradually decreased as it goes to the side opposite to the air intake port so that the combustion air is permitted to flow from the air introducing holes into the combustion cylinder smoothly and uniformly, and microswirls are generated in the combustion cylinder due to pulsation and disturbance of the air so that there is formed an ideal mixture.

Yet further object of the present invention is to provide a burner in which the combustion cylinder is provided with an atomizer that has a glow plug for atomization which consists of a resistance wire buried in a silicon nitride member, so that the liquid fuel is quickly and reliably atomized by the flow plug for atomization at the start of combustion, the atomized fuel is injected into the atomizing chamber and once there takes place the combustion briskly, the atomized fuel is readily formed owing to the heat of vaporization such as radiant heat from the combustion chamber even after the supply of current to the glow plug for atomization is discontinued.

A further object of the present invention is to provide a burner in which the atomizing chamber is provided with a glow plug for ignition so that the atomized fuel obtained by quickly atomizing the liquid fuel is ignited without failure, and the atomized fuel is quickly ignited and is burned quickly and reliably making it possible to produce the warming effect quickly.

DETAILED DESCRIPTION OF THE EMBODIMENT

A burner according to an embodiment of the present invention will now be described in conjunction with FIG. 1.

Figure 1:
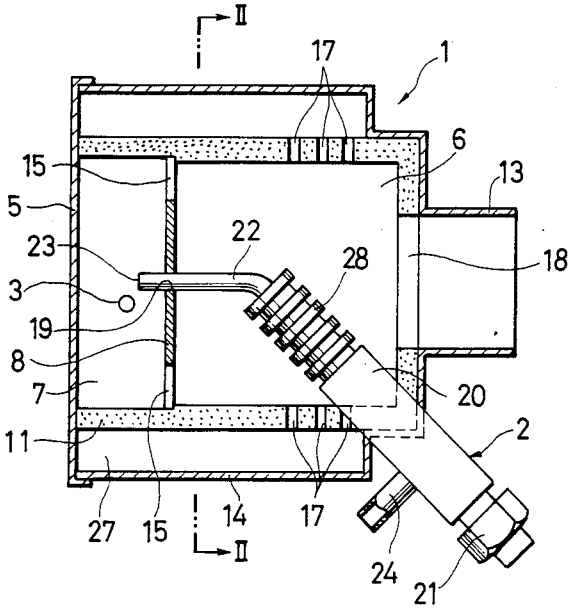
FIG. 1 is a section view illustrating a burner according to an embodiment of the present invention.

In FIG. 1 the burner according to the present invention is generally designated at 1. According to this burner 1, the air is intaken through an air cleaner of a diesel engine or a gasoline engine or through its own air cleaner, or is directly intaken from the open air or from the room via an air intake pipe 12 (see FIG. 2), and the combustion gas of the burner 1 is directly delivered into the room from a combustion gas delivery pipe 13 or is delivered into a heat exchanger installed on the downstream side. When the combustion gas is to be delivered to the heat exchanger installed in the downstream side, the heat exchanger may be installed in series with the burner 1 on the downstream side thereof, or may be installed on the outer peripheral side of the burner 1. The burner 1 is comprised of a ceramic combustion cylinder 11, a metallic outer cylinder 14 which surrounds the combustion cylinder 11, and a metallic cover plate 5 which seals the ends of the combustion cylinder 11 and the outer cylinder 14. The other end of the outer cylinder 14 is provided with the metallic combustion gas delivery pipe 13.

Figure 2:
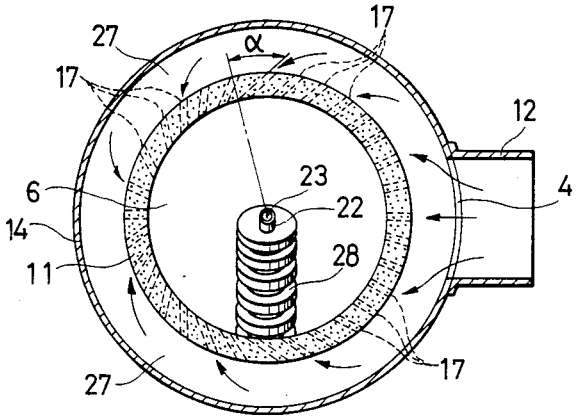
FIG. 2 is a section view along the line II—II of FIG. 1.
Figure 3:
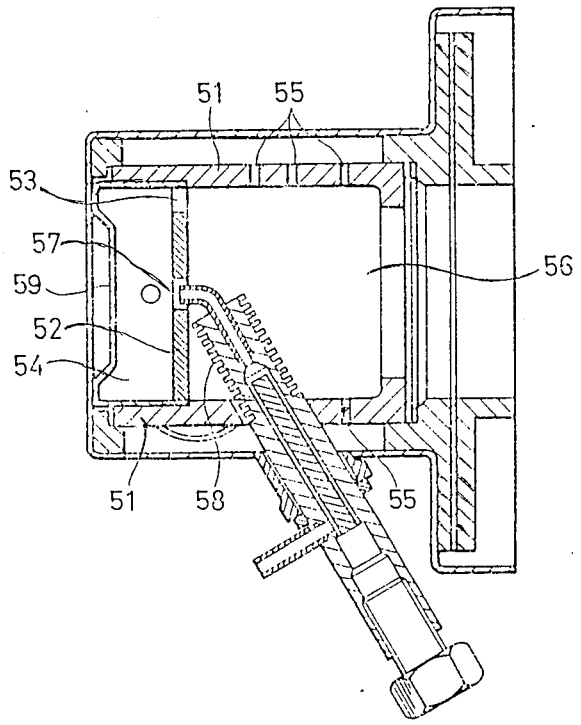
FIG. 3 (PRIOR ART)
FIG. 3 is a section view of a burner of a prior application filed by the applicant of the present invention.

With reference to FIG. 2, the outer cylinder 14 has an air intake port 4, and a cylindrical portion that forms the air intake port 4 is provided with the metallic air intake pipe 12 which is perpendicularly mounted relative to the radial direction of the outer cylinder 14, i.e., relative to the outer cylinder 14. The interior of the combustion cylinder 11 is divided into two chambers, i.e., divided into an atomizing chamber 7 and a combustion chamber 6 by a partitioning plate 8 which has a plurality of cut-away paths or openings 15 formed in the peripheral portion thereof. Many air introducing holes 17 are formed in the peripheral wall of the combustion cylinder 11 which constitutes the combustion chamber 6 on the downstream side thereof. The air introducing holes 17 are formed in the combustion cylinder 11 being tilted along the line of air stream. When the combustion cylinder 11 has a cylindrical shape, the tilting angle $\alpha$ of the air introducing holes 17 formed in the combustion cylinder 11 gradually increases starting from a portion opposed to the air intake port 4 formed in the outer cylinder 14 and then gradually decreases as it goes toward the side opposite to the air intake port 4. An annular air introducing path 27 is formed between the combustion cylinder 11 and the outer cylinder 14, through which the combustion air passes in a whirling manner. A combustion gas delivery port 18 is formed in an end of the combustion chamber 6 on the side opposite to the atomizing chamber 7.

An atomizer 2 aslantly penetrates through the combustion chamber 6 from a corner portion on the downstream side of the combustion chamber 6 toward an opening, i.e., toward a communication hole 19 formed at the central portion of the partitioning wall 8. A fuel injection port 23 of the atomizer 2 is opened in the atomizing chamber 7. Further, a glow plug 3 for ignition, which is a heating plug, is provided in the atomizing chamber 7. The atomizer 2 is made up of a glow plug for atomization buried in a metallic atomizer pipe 20. The glow plug for atomization, which is a heating plug, is obtained by burying a resistance wire composed of tungsten in a silicon nitride member. The atomizing pipe 20 has at its end a terminal 21 through which the electric current will be supplied to the resistance wire. On the other end of the atomizer pipe 20 is mounted an injection pipe 22 having a diameter smaller than that of the atomizing pipe 20, and an injection port 23 is formed at the end of the injection pipe 22. To the atomizer pipe 20 is connected a fuel supply pipe 24. Heat-receiving fins 28 are formed on the outer peripheral surface of the atomizer pipe 20. An injection pipe 22 extends from the end of the atomizer pipe 20 and penetrates through the communication hole 19 formed i the partitioning plate 8. Moreover, the injection part 23 formed at the end of the injection pipe 22 is open at a position close to the glow plug 3 for ignition provided in the atomizing chamber 7.

In the burner 1, the combustion cylinder 11 which constitutes the atomizing chamber and the combustion chamber 6 is made of a dense or porous ceramic material having a small coefficient of thermal expansion. Of example, the ceramic member may be composed of cordierite which has a porous consistency and a small coefficient of thermal expansion. Furthermore, the boundary region, i.e., the partitioning plate 8 between the atomizing chamber 7 and the combustion chamber 6, and the bottom surface of the atomizing chamber, may be compose of a material having good heat conductivity. The cover plate 5 of the atomizing chamber 7 may be composed of a dense or porous ceramic material having a small coefficient of thermal expansion.

The burner 1 according to the present invention is constructed as described above, and operates as described below.

An electric current is supplied to the resistance wire of the glow plug for atomization in the atomizer pipe 20 to heat the glow plug for atomization, and the liquid fuel is supplied through the fuel supply pipe 24. The liquid fuel is atomized in the atomizer pipe 20, and the atomized fuel is injected into the atomizing chamber 7 from the injection port 23 of injection pipe 22 through space between the atomizer pipe 20 and the atomizing glow plug. The combustion air, on the other hand, is introduced through the air intake pipe 12, and as blown into the combustion chamber 6 from the air introducing holes 17 via the annular air introducing path 27 between the outer cylinder 14 and the combustion cylinder 11. The air introducing holes 17 are formed in the combustion cylinder 11 maintaining tilting angles relative thereto, and the combustion air is blown through the combustion cylinder 11 under a very ideal condition, whereby it is ideally mixed with the atomized fuel to form a mixture. Furthermore, part of the combustion air blown into the combustion chamber 6 is smoothly sent into the atomizing chamber 7 passing through cut-away paths 15 of the partitioning plate 8, and where the fuel mixed with the combustion air is ignited by the igniting glow plug 3, so that the atomized fuel and the combustion air mixed together undergo the combustion. Then, the atomized fuel is blown through the cut-away paths 15 into the combustion chamber 6 where it is homogeneously mixed with the combustion air to burn completely and briskly. The atomized fuel that has burned is converted into combustion gas which is delivered into the heat exchanger from the combustion gas delivery port 18 formed at an end on the downstream side of the combustion cylinder 11 via a combustion gas delivery pipe 13. As the combustion becomes brisk in the combustion chamber 6, the heat of vaporization is received through the atomizer pipe 20 of the atomizer 2 and the heat-receiving fins 28 provided on the atomizer pipe 20. Under this condition, the electric current is no more supplied to the atomizing glow plug. Thereafter, the liquid fuel is vaporized upon receiving the heat of vaporization, i.e., upon receiving the heat of combustion from the combustion chamber 6, and is mixed with the combustion air to sustain the combustion. Owing to the combustion, the liquid fuel is heated and atomized by the atomizing glow plug, so that the atomized fuel is injected from the injection port 23. In this case, if the liquid fuel is not perfectly liquefied or if the fuel atomized from the injection port 23 contains fuel droplets, the fuel droplets impinge upon the cover plate 5 and the combustion cylinder 11, whereby the fuel in the form of liquid flows down onto the bottom along the cover plate 5 and the partitioning plate 8. In such a case, a ceramic member may be mounted on the cover plate 5 to impart heat-insulating property, so that the cover plate will not be cooled by the external air. Therefore, the fuel that has impinged and the fuel droplets are prevented from losing the heat, and the atomized fuel is prevented from returning into liquid.

In the foregoing was described in detail the burner according to the embodiment of the present invention. The invention, however, is in no way limited thereto only, but may be constructed in the lateral type in which the combustion cylinder is installed nearly horizontally, or may be constructed in the vertical type in which the combustion cylinder is installed nearly in a vertical direction, or may be constructed in such a type that the combustion cylinder is installed in a tilted manner, depending upon the conditions where it is to be installed. The partitioning plate which divides the interior of the combustion cylinder may have openings consisting of a plurality of through holes formed at suitable positions therein instead of forming a plurality of cut-away paths in the peripheral edge thereof. Or, the partitioning plate may have both the cut-away paths and the through holes. The cover plate may be lined with a dense or porous ceramic material having a small coefficient of thermal expansion. Furthermore, though the air intake pipe and the atomizer are provided in directions maintaining an angle of about 90 degrees (or about 270 degrees from the opposite direction) in the drawing, they need not be limited to such positions only, as a matter of course.

What is claimed is:

1. A burner comprising a combustion cylinder defining an atomizing chamber and a combustion chamber separated by a partition having at least one opening therethrough, a fuel injection port of an atomizer opening into said atomizing chamber, said atomizer opening into said atomizing chamber, said atomizer penetrating said partition and extending through said combustion chamber from a corner portion on the downstream side of said combustion cylinder, ignition means provided in said atomizing chamber to effect combustion, an outer cylinder so arranged as to form an annular air introducing path which surrounds the outer periphery of said combustion cylinder, and air introducing holes formed in said combustion cylinder tilted along the line of an air stream passing along said annular air introducing path, said air introducing holes being tilted at different tilting angles to provide means for introducing air into the combustion chamber smoothly and uniformly and to generate microswirls in the combustion cylinder.

2. A burner according to claim 1, wherein said outer cylinder is provided with an air intake pipe in the radial direction thereof.

3. A burner according to claim 1, wherein the tilting angle of said air introducing holes formed in said combustion cylinder gradually increases starting from a portion opposed to the air intake port formed in said outer cylinder and then gradually decreases as it goes toward the side opposite to said air intake port.

4. A burner according to claim 1, wherein said ignition means is a glow plug

5. A liquid fuel burner comprising: a combustion cylinder for defining a composite chamber; a partitioning plate disposed inside said combustion cylinder and equipped with a plurality of openings for dividing said composite chamber into an atomizing chamber and a combustion chamber; a large number of air introducing holes at that portion of said combustion cylinder at which said combustion chamber is formed; an outer cylinder disposed on the outer periphery of said combustion cylinder, for forming an annular air introducing path between said outer cylinder and said combustion cylinder; an air intake pipe connected to said annular air introducing path; a fuel atomizing device for atomizing a fuel and supplying said atomized fuel into said atomizing chamber; and ignition means disposed in said atomizing chamber, for igniting the fuel in said atomizing chamber;

wherein said air intake pipe is fitted to said outer cylinder in its radial direction;

and said air introducing holes formed on said combustion cylinder are tilted at different tilting angles towards the air intake port side of said outer cylinder with respect to the radial axis of said combustion chamber and are set in such manner that the tilting angle is small for air introducing holes on the air intake port side and become progressively greater in the circumferential direction of said combustion cylinder reaching a maximum at an intermediate portion, and then become progressively smaller starting at said intermediate portion and reaching a minimum on the side opposite to said air intake port.

6. A burner according to claim 5, wherein said combustion cylinder is made of a ceramic material.

7. A burner according to claim 5, wherein said atomizing device contains a glow plug for atomization which consists of a resistance wire buried in a silicon nitride member.

* * * * *